US005333880A

United States Patent [19]

Allbright

[11] Patent Number: 5,333,880

[45] Date of Patent: Aug. 2, 1994

[54] SYSTEM FOR SUPPORTING AND TENSIONING A VOLLEYBALL NET

[76] Inventor: Edwin T. Allbright, 3130 Lowell Blvd., Denver, Colo. 80211

[21] Appl. No.: 174,128

[22] Filed: Dec. 28, 1993

[51] Int. Cl.[5] ..... A63B 61/04

[52] U.S. Cl. ..... 273/411

[58] Field of Search ..... 273/411, 29 B

[56] References Cited

U.S. PATENT DOCUMENTS

| | | | |
|---|---|---|---|
| D. 308,473 | 6/1990 | Pohrer | 273/411 |
| 1,509,490 | 9/1924 | Sawyer | 273/411 |
| 2,638,346 | 5/1953 | Stapleton | 273/411 |
| 3,435,487 | 4/1969 | Mazzei et al. | 273/411 |
| 3,940,139 | 2/1976 | Barnes | 273/411 |
| 4,153,247 | 5/1979 | Burns | 273/411 |
| 4,253,671 | 3/1981 | Pace | 273/411 |
| 4,415,163 | 11/1983 | Schoenig | 273/411 |
| 4,720,112 | 1/1988 | Stetter et al. | 273/411 |
| 4,830,382 | 5/1989 | Wheeler | 273/411 |
| 4,844,477 | 7/1989 | Pardi | 273/411 |
| 4,968,042 | 11/1990 | Stewart | 273/411 |
| 4,973,059 | 11/1990 | Stewart | 273/411 |
| 5,058,899 | 10/1991 | Jackson et al. | 273/411 |
| 5,083,797 | 1/1992 | Vartija et al. | 273/411 X |
| 5,269,533 | 12/1993 | Kellams | 273/411 |

FOREIGN PATENT DOCUMENTS

| | | | |
|---|---|---|---|
| 1562025 | 3/1980 | United Kingdom | 273/411 |

OTHER PUBLICATIONS

"The Kil-Kourt-A Portable Outdoor Volleyball Court System" brochure by AA Sports, Inc., 3544 North Southport Avenue, Chicago, Ill. 60657 (1984).

*Primary Examiner*—William H. Grieb

*Attorney, Agent, or Firm*—Dorr, Carson, Sloan & Peterson

[57] ABSTRACT

A tensioning and support system for a sports net assembly includes two standards spaced a predetermined distance apart and a net suspended between the standards with a net rope extending along its upper edge. A number of guy ropes support each standard. At one end of the assembly, the net rope can slide relative to the standard, but includes a sliding locking mechanism for adjustably fixing the position of the standard relative to the net rope. The desired degree of tension is first placed on the top net rope. The guy rope is temporarily attached to the top net rope to maintain tension on the net rope while the sliding locking mechanism is moved along the top rope to fix the position of the standard relative to the net rope. Finally, the guy rope is detached from the top net rope and secured to the standard to complete installation.

13 Claims, 5 Drawing Sheets

SYSTEM FOR SUPPORTING AND TENSIONING A VOLLEYBALL NET

BACKGROUND OF THE INVENTION

1. Field of the Invention

The present invention relates generally to the field of volleyball nets and other types of sports nets. More specifically, the present invention discloses a system for supporting and tensioning a volleyball net so that the top edge of the net is stretched by the same amount as the bottom edge of the net to maintain vertical alignment of the standards.

2. Statement of the Problem

In conventional volleyball nets, the upper edge of the net is subject to a much greater tensile force than the lower edge of the net. However, the predominant portion of this tensile force is carried by the net rope extending along the top edge of the net, rather than by the binding or the net itself. A problem tends to arise in those situations where the net is supported by means of two sleeves (e.g. made of vinyl) extending along the lateral edges of the net that slip over the upper portion of the standards. A lesser, although still substantial, tensile force must be carried by the binding (e.g., a vinyl tape) extending along lower edge of the net so that the volleyball rebounds from the net in the proper manner. In contrast to the upper tape, this tensile force is carried primarily by the lower vinyl tape which therefore tends to stretch more than the upper edge of the net. After this uneven stretching has progressed beyond a certain point, it becomes difficult to reassemble the net with proper tension on the bottom edge of the net unless the standards are tilted inward from vertical. Therefore, it is desirable to allow the upper tape to stretch to compensate for stretching of the lower tape, and thereby preserve the vertical orientation of the standards. In particular, the user should be able to adjust the vertical orientation of the standard and adjust the tensioning force on the top rope of the net independently of each other.

A number of devices have been invented in the past for supporting and tensioning volleyball nets, including the following:

| Inventor | Patent No. | Issue Date |
|---|---|---|
| Stapleton | 2,638,346 | May 12, 1953 |
| Mazzei, et al. | 3,435,487 | April 1, 1969 |
| Barnes | 3,940,139 | Feb. 24, 1976 |
| Burns | 4,153,247 | May 8, 1979 |
| Chell | British Patent Spec. 1562025 | March 5, 1980 |
| Pace | 4,253,671 | March 3, 1981 |
| Stetter, et al. | 4,720,112 | Jan. 19, 1988 |
| Wheeler | 4,830,382 | May 16, 1989 |
| Pardi | 4,844,477 | July 4, 1989 |
| Pohrer | Des. 308,473 | June 12, 1990 |
| Stewart | 4,968,042 | Nov. 6, 1990 |
| Stewart | 4,973,059 | Nov. 27, 1990 |

"The Kil-Kourt - A Portable Outdoor Volleyball Court System" brochure by AA Sports, Inc., 3544 North Southport Avenue, Chicago, Illinois 60657 (1984).

Barnes and Stapleton disclose volleyball net assemblies using a winch to simultaneously tension both the upper and lower ropes of the net.

Mazzei, et al., disclose a stabilizer for releasable attachment to each end of a volleyball net. Each stabilizer includes a resilient connector for tensioning the net.

Burns discloses a ratchet mechanism for applying equal tension to the upper and lower ropes of a game net, as best shown in FIG. 4 of this patent.

Chell discloses a tennis net having a net rope 32 that is routed over a metal eyelet and held by a knot 35 at the base of the post. It appears that the net rope is not used for tensioning.

The Pace, Pohrer, and Pardi patents are examples of pulley and ratchet arrangements used to tension the net rope of a game net assembly.

Stetter, et al., disclose an adjustable height standard for net games. The standard is comprised of a pair of telescoping tubes. Each tube has a set of spaced holes formed in the tube wall. A hitch pin is inserted through various combinations of holes in the two tubes to select a desired height.

Wheeler discloses a portable volleyball net support system. One end of the upper net rope is directed downwardly along the standard through an eye bolt. The free end of the rope is secured by a oneway cleat attached to the standard.

The Stewart patents disclose a two volleyball net adjustment system in which winch and pulley arrangements simultaneously tension both the top and bottom net ropes.

The 1984 brochure by AA Sports, Inc., discloses a volleyball net tensioning system in which a compound pulley is used to adjust the tension placed on the upper rope of the net. A clam cleat positioned above the upper pulley is used to secure the upper net rope after appropriate tension has been applied. The lower rope of the net is separately tensioned by hand and then secured by means of a second cleat.

3. Solution to the Problem

None of the prior art references uncovered in the search show a support and tensioning system for volleyball nets having the structure of the present system. In particular, the present system allows the upper edge of the net to be stretched by the same amount as the lower edge of the net to preserve vertical alignment of the standards.

SUMMARY OF THE INVENTION

This invention provides a tensioning and support system for a sports net assembly. Two standards are spaced a predetermined distance apart with a net suspended between the standards by a net rope extending along the upper edge of the net. A number of guy ropes support each standard. At one end of the assembly, the net rope can slide relative to the standard, but includes a sliding locking mechanism for adjustably fixing the position of the standard relative to the net rope. The desired degree of tension is first placed on the net rope. The guy rope is temporarily attached to the net rope to maintain tension on the net rope while the sliding locking mechanism is moved along the net rope to fix the position of the standard relative to the net rope. Finally, the guy rope is detached from the net rope and secured to the standard.

A primary object of the present invention is to provide a means to allow the upper edge of the net to stretch to match the amount of stretching experienced by the lower edge of the net, and thereby maintain the vertical orientation of the standards.

Another object of the present invention is to provide a means of tensioning the upper edge of a net suspended by lateral sleeves that does not tend to tilt or bow the standards.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
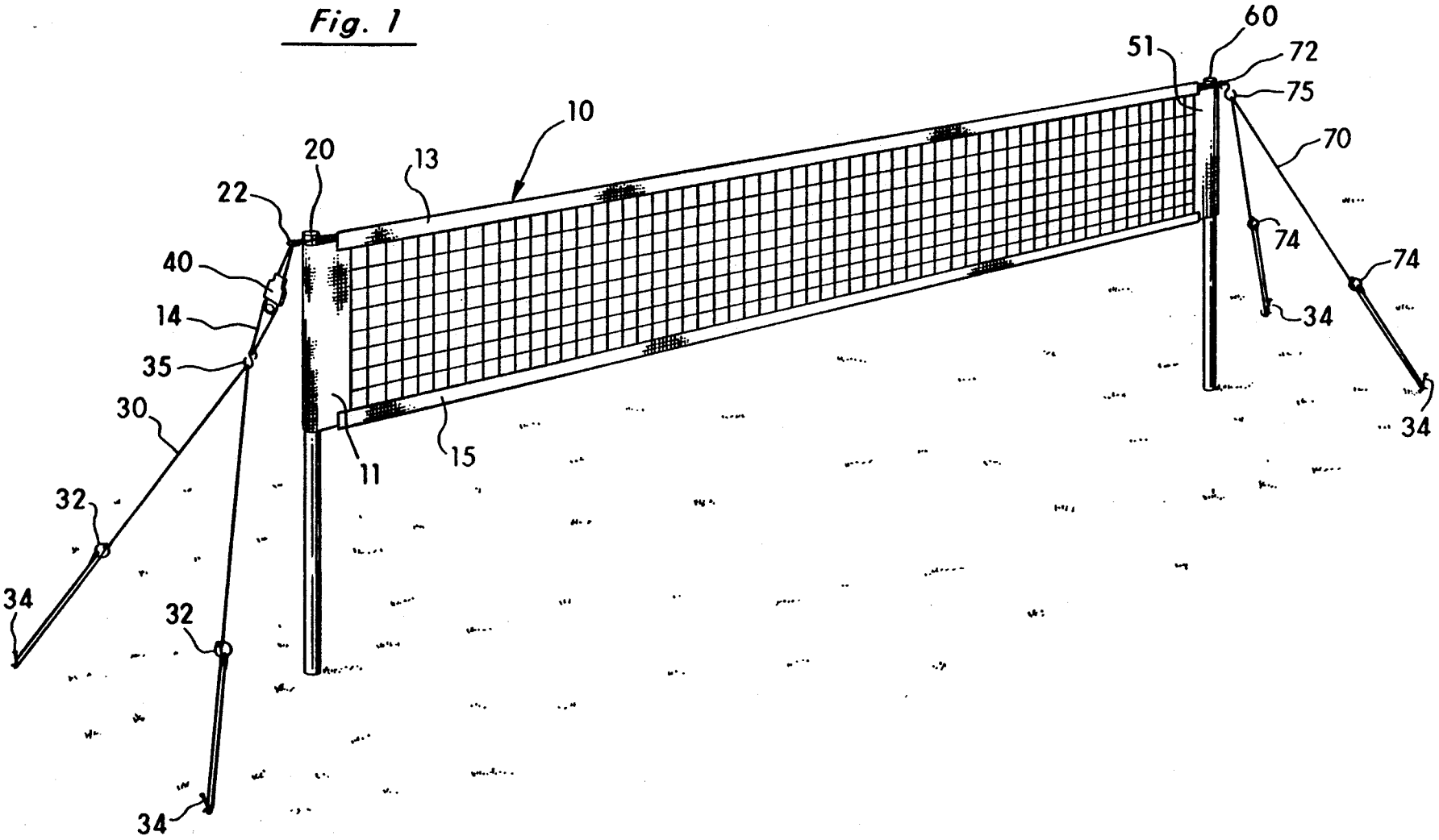
FIG. 1 is a perspective view showing the overall system (including the volleyball net, net rope, two standards, guy ropes, and sliding locking mechanisms) after the first step in which the top net rope has been tensioned and temporarily attached to the guy rope.

Turning to FIG. 1, a perspective of the entire assembly is provided. The embodiment shown in the drawings is a volleyball net assembly. However, it should be expressly understood that the present invention could be readily adapted to other types of sports net assemblies, such as tennis or badminton nets.

As shown in FIG. 1, the volleyball net 10 is generally rectangular in shape with a top edge, a bottom edge and two opposing lateral edges. Two vertical standards 20 and 60 are employed to support the lateral ends of the net 10. These vertical standards can be simple, one-piece poles mounted in the ground a predetermined distance apart from one another. Alternatively, the standards can have a multi-piece tubular construction allowing adjustment of the height of the net 10.

A number of guy ropes 30 and 70 provide lateral support for the standards 20 and 60. The lower ends of the guy ropes 30 and 70 are secured by stakes 34 to the ground. The upper portion of each guy rope 30 and 70 bears a fastener 35 and 75, such as a hook or clasp, that can be removably attached to the upper portion of the standard 20 and 60 during assembly, as will be described in greater detail below. Alternatively, the guy ropes 30 and 70 can have the structure shown in FIG. 1 in which both ends of the guy rope are staked to the ground. The fastener 35 and 75 is located in the middle portion of the guy rope which is then elevated for attachment to the standards 20 and 60. In the preferred embodiment, the guy ropes 30 and 70 also include a mechanism 32 and 74 to allow manual adjustment of the length of the guy ropes.

In the embodiment shown in the drawings, the net is attached by means of two sleeves 11 and 51 extending along the lateral edges of the net 10. The upper ends of the standards 20 and 60 are inserted through these sleeves 11 and 51. Alternatively, the net 10 can be attached to the standards by straps extending laterally from the net that are tied to the standards. In a second alternative embodiment, the net 10 is suspended by means of a rope or cable extending along the top of the net that is secured to the standards.

The net assembly includes a top net rope 12 that runs inside a vinyl binding (or "tape") 13 along the top edge of the net 10 as shown in FIG. 1 between the left and right sleeves 11 and 51. A second vinyl tape 15 extends along the lower edge of net 10 between the sleeves 11 and 51.

The ends of the top net rope 12 extend outward beyond the lateral edges of the net 10 toward the standards 20 and 60. Each end of the top net rope 12 is folded back upon itself to form a loop 14. As shown in FIG. 1, the loop at the right end of the net 10 is secured around the upper end of the right standard 60, and the guy rope hook 75 is fastened directly to the eye-bolt 72 attached to the upper end of the right standard 60. In contrast, the loop at the left end of the top net rope 12 passes through the eye-bolt 22 attached to the left standard 20. This loop is then attached to the guy rope hook 35. Alternatively, some other type of complementary fastener (e.g., a ring, hook, or clasp) could be attached to the left end of the top net rope 12 to connect with the hook 35 attached to the guy rope 30.

Figure 3:
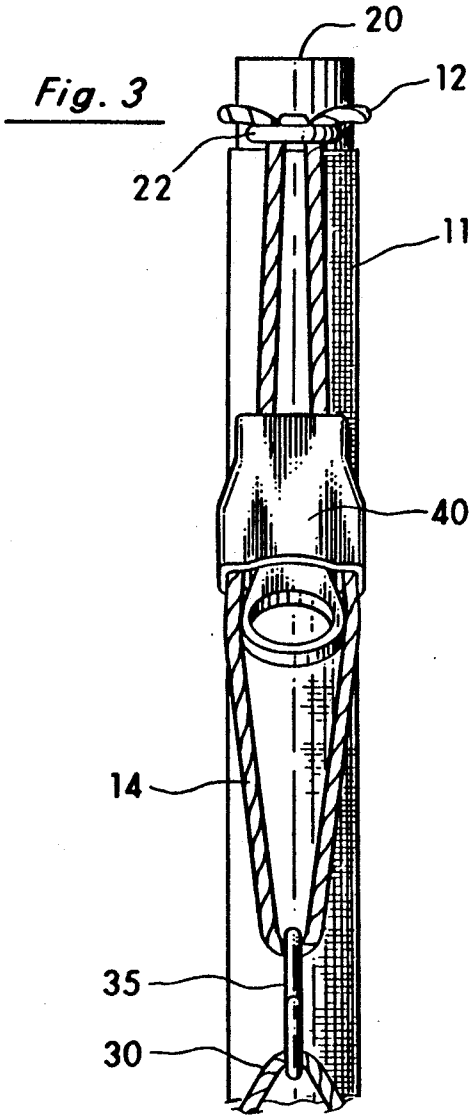
FIG. 3 is a fragmentary side view corresponding to FIG. 2 showing the sliding locking mechanism on the top net rope after completion of the first step.

The following is a summary of the installation process. First, the net 10 is loosely attached to the standards 20 and 60 by passing the top end of each standard through the corresponding loop 14 in the top net rope 12. This positions one arm of the loop 14 in front of the standard 20 while the other arm of the loop lies to the rear of the standard, as shown in FIGS. 1 and 3. At one end of the assembly (e.g., the left end in the drawings), the distal end of the loop 14 is then drawn through the eye-bolt 22 extending from the upper end of the standard 20. The eye-bolts 22 and 72 are located at approximately the desired height for the top of the net 10 since one of the functions of the eye-bolts 22 is to provide vertical support for the top net rope 12. Alternatively, a hole through the standards or a support peg extending from the standards could be substituted for the eyebolts 22 and 72 to support the net rope.

Figure 2:
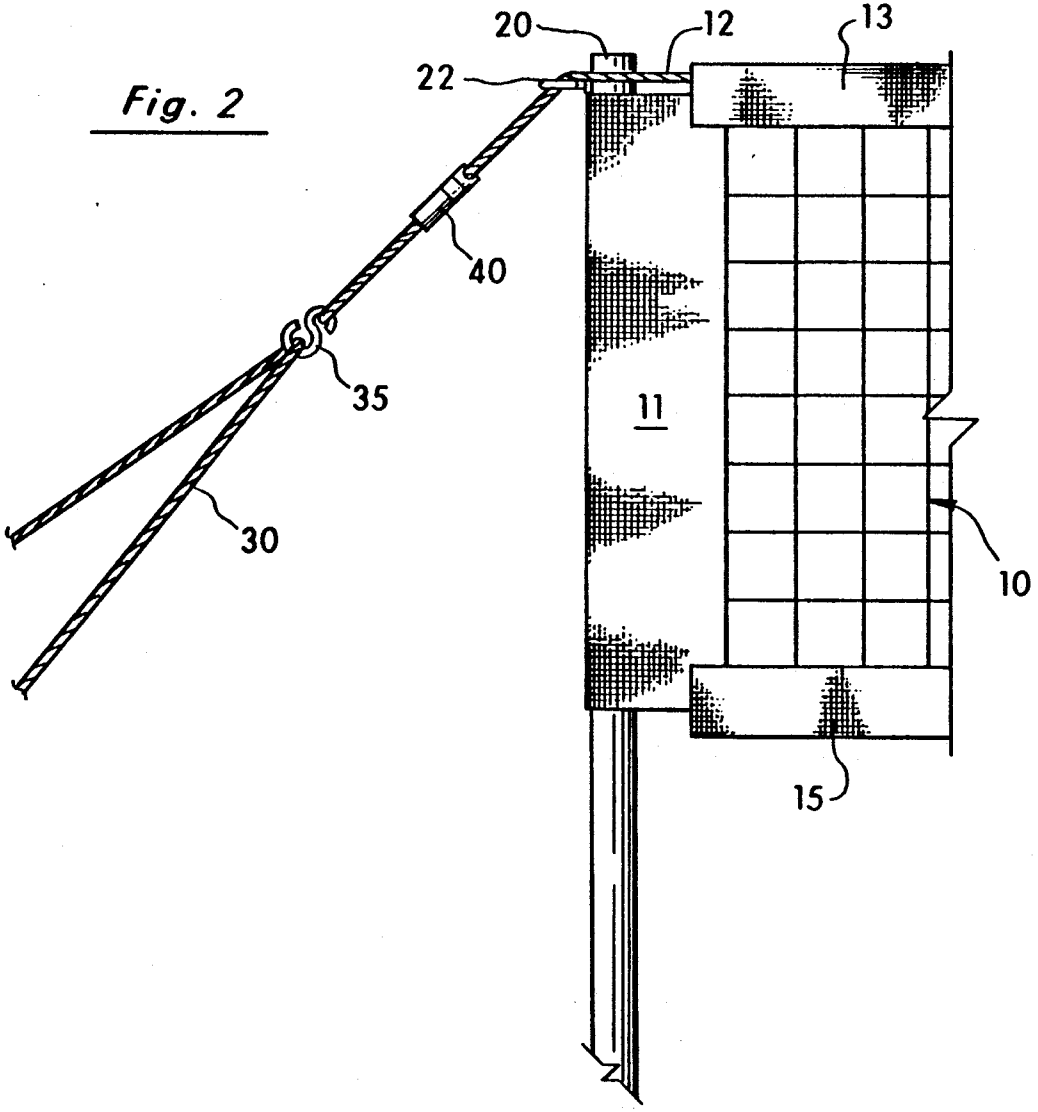
FIG. 2 is a detailed front view of one end of the net corresponding to FIG. 1 showing the details of the tensioning system after completion of the first step.

The hook 35 attached to the left guy rope 30 is then temporarily fastened to the loops 14, as shown in FIGS. 1–3. In contrast, the hook attached to the right guy rope 70 is fastened directly to the eye-bolt 72 secured to the right standard 60, as previously mentioned. Next, the user exerts a tensile force on either the left loop 14 or the guy rope 30 to apply appropriate tension to the top net rope 12. The length of the guy rope is then adjusted accordingly to maintain this tension on the top net rope.

After completion of this first step, the tension placed on the top net rope 12 is carried almost entirely by the loops 14 and the guy ropes 30 and 70 at either end of the volleyball net assembly. The standards 20 and 60 are subject to a relatively small downward force vector due to the top net rope being vertically supported by the eye-bolts 22 and 72 secured to the standards. The standards also bear some relatively minor lateral loads caused by supporting the net 10 via the net sleeves 11 and 51. However, it should be noted that the position of the upper end of the left standard 20 is not fixed relative to top net rope 12 at this point. In fact, the vertical orientation of the standards can be readily adjusted within a wide range by sliding the upper end of the left standard 20 along the length of the top net rope loop 14. Furthermore, the left standard 20 is not subject to the tensile force placed on the top net rope 12 in this step.

A sliding locking mechanism 40 is attached at the left end of the top net rope 12 in the section of the rope beyond eye-bolt 22 and distal from the left standard 20, as shown in FIGS. 1–3. The locking mechanism 40 is intended to slide along the top net rope 12 anywhere between the point of attachment to the guy rope 30 and the eye-bolt 22. In the embodiment shown in the drawings in which the top net rope 12 forms a loop 14, the sliding locking mechanism 40 simultaneously slides along both arms or branches of the loop 14.

Figure 8:
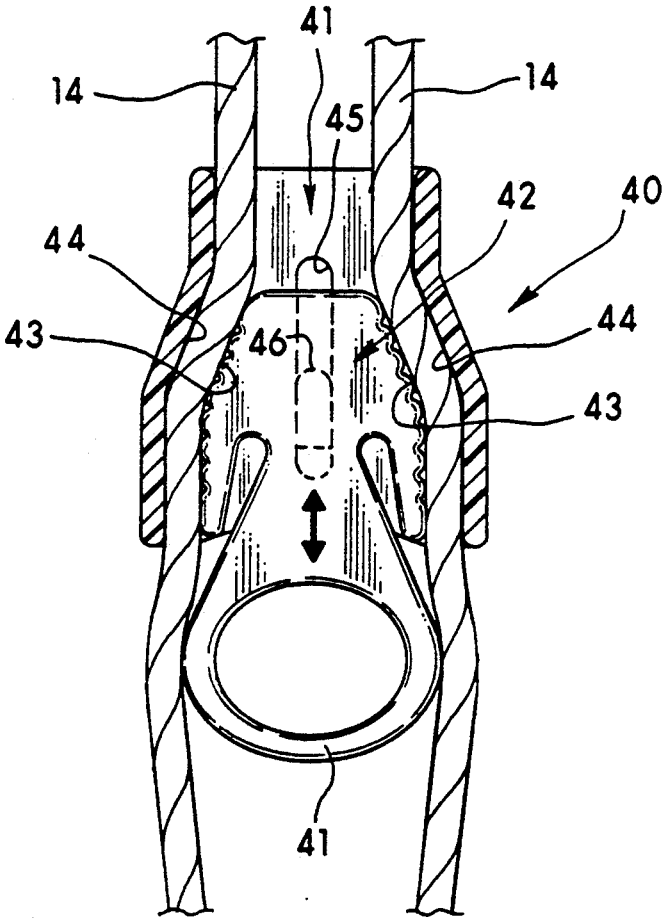
FIG. 8 is a cross-sectional view of the sliding locking mechanism.

FIG. 8 shows a cross-sectional view of the sliding locking mechanism 40 intended especially for this embodiment of the present invention. The locking mechanism 40 consists of an outer housing 44 and an inner sliding member 42 with two channels therebetween to hold both arms of the loop 14. The outer housing 44 includes a vertical slot 45 which receives a tab 46 extending outwardly from the sliding member 42 to permit a limited range of vertical motion between the outer housing 44 and the sliding member 42. The channel surfaces of the sliding member 42 are equipped with a number of teeth 43 to grip the loop 14. The channels are shaped such that any downward force on the outer housing 44 of the locking mechanism 40 will cause the sliding member 42 to grip the loop 14 more tightly and thereby locks the mechanism in position on the top net rope 12. However, in contrast, any upward force on the outer housing 44 of the locking mechanism 40 tends to release the sliding member 42 and allows the mechanism to slide freely upward along the top net rope 12. The sliding member 42 also includes a pull ring 41 as shown in FIG. 8. By pulling downward on 15 this ring 41, the user can release the locking mechanism's grip on the loop 14 and slide the locking mechanism downward along the top net rope 12.

Figure 5:
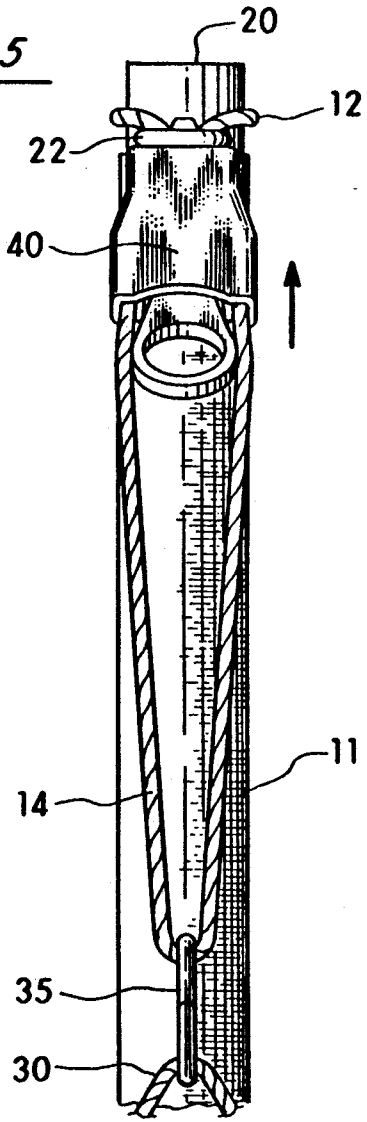
FIG. 5 is a fragmentary side view corresponding to FIG. 4 showing the sliding locking mechanism on the top net rope after it has been moved upward to contact the eye-bolt.
Figure 4:
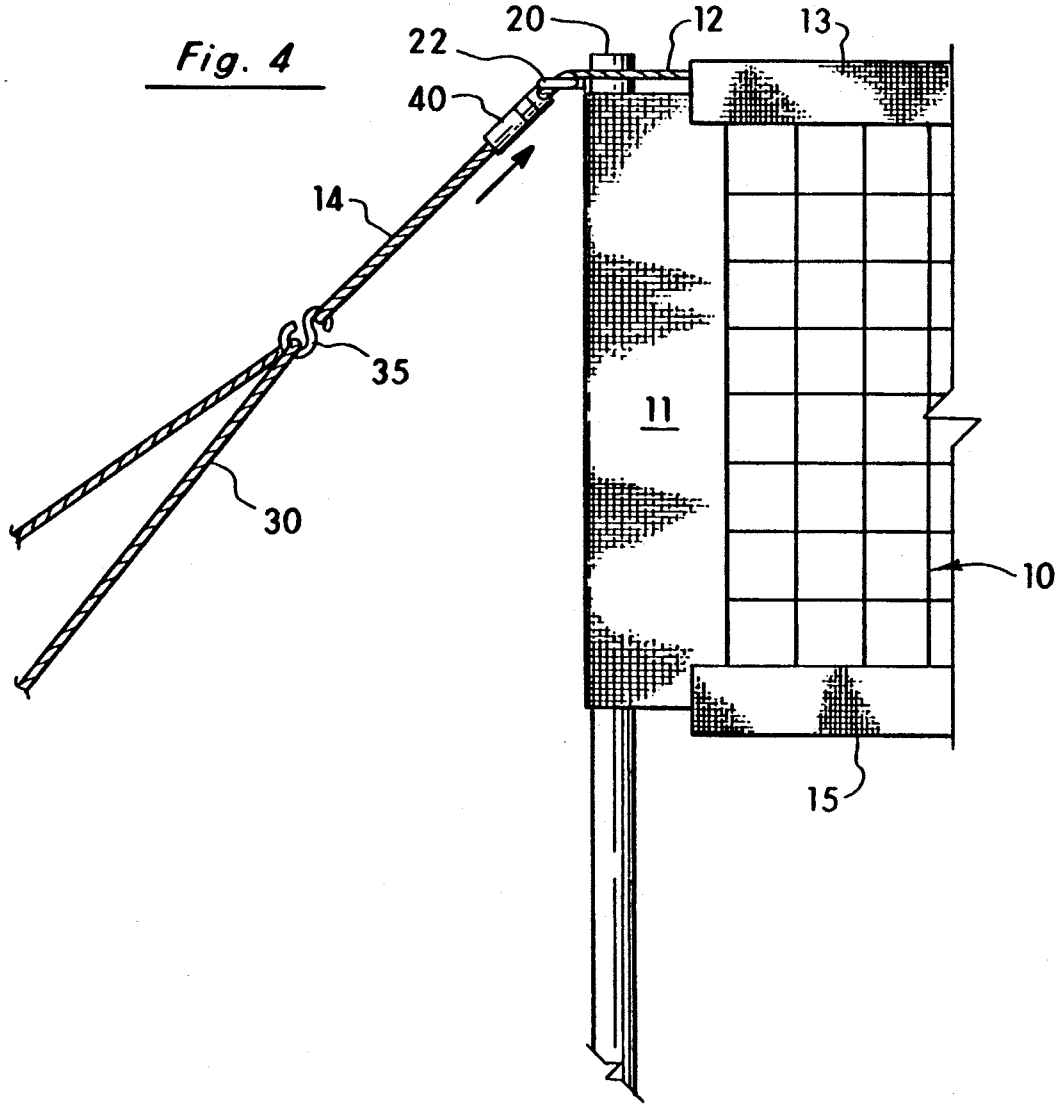
FIG. 4 is a detailed front view of one end of the net, similar to FIG. 2, after completion of the second step in which the sliding locking mechanism has been moved upward along the top net rope to contact the eye-bolt secured to the standard.

After the left guy rope 30 has been temporarily attached to the loop 14 in the top net rope 12 during the initial assembly process, the user slides the locking mechanism 40 upward along the top net rope until the locking mechanism 40 contacts the eye-bolt 22 secured to the left standard 20, as shown in FIGS. 4 and 5. The locking mechanism 40 is then locked in place against the eye-bolt 22. In other words, the function of the sliding locking mechanism 40 is to adjustably fix the length of the top net rope 12 between the standards 20 and 60, and thereby control the spacing and vertical orientation of the standards.

Figure 7:
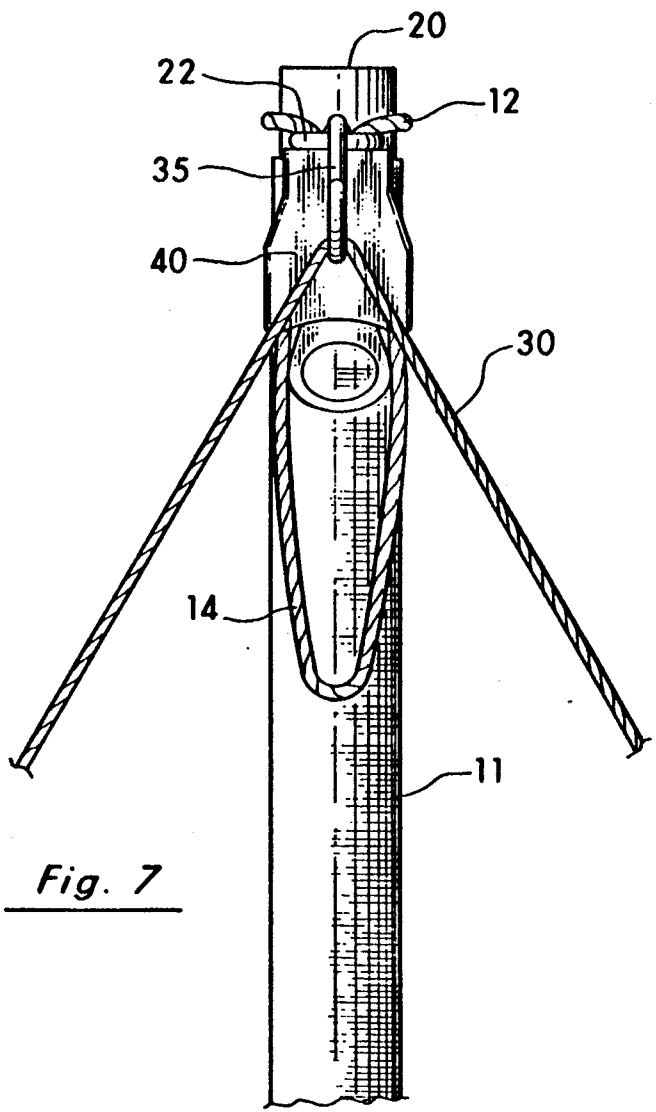
FIG. 7 is a fragmentary side view corresponding to FIG. 6 showing the sliding locking mechanism in contact with the eye-bolt and the guy rope fastened to the eye-bolt.
Figure 6:
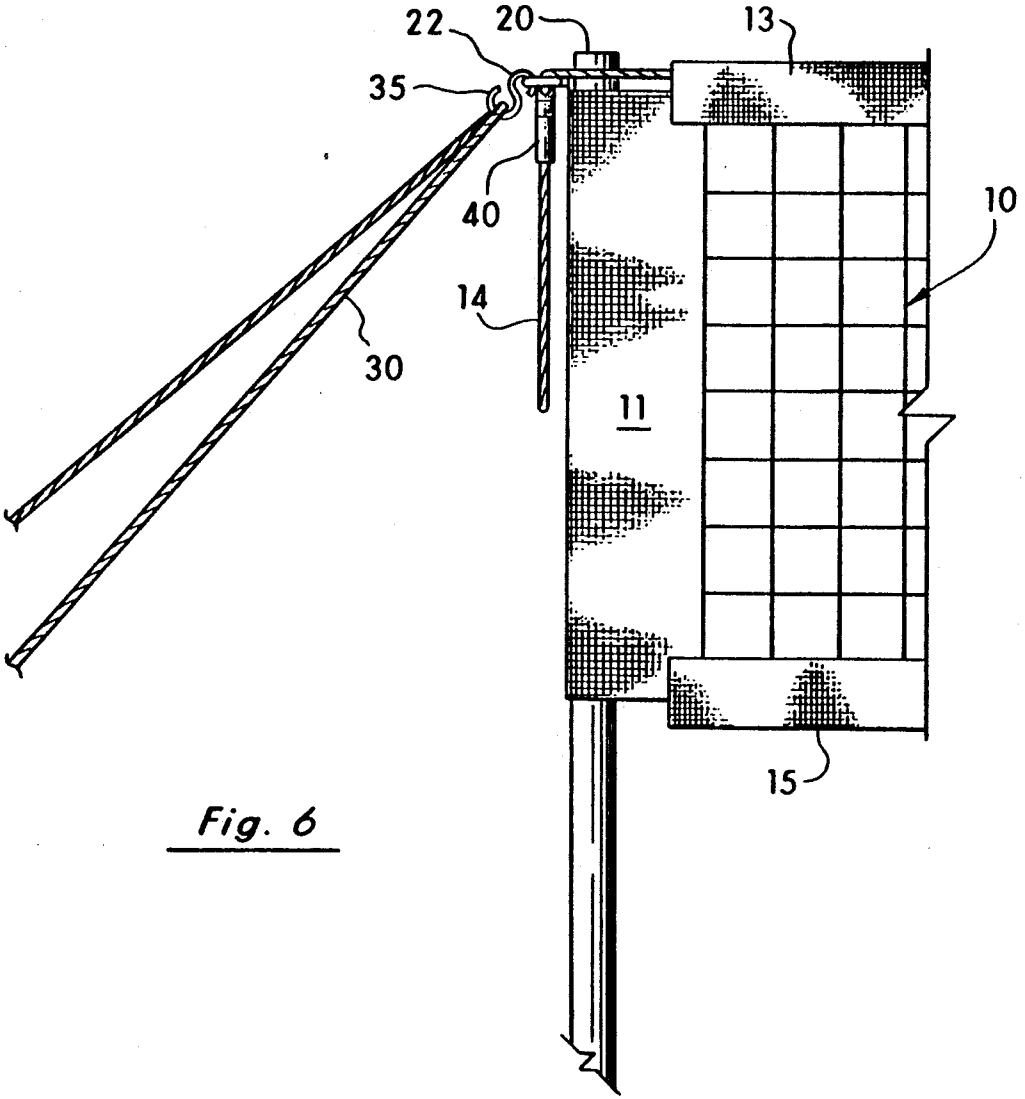
FIG. 6 is a detailed front view of one end of the net, similar to FIGS. 2 and 4, after the third step in which the guy rope has been detached from the top net rope and fastened to the eye-bolt secured to the standard.

In the final step, the user disconnects the left guy rope 30 from the loop 14 and then attaches the hook 35 on the end of the guy rope 30 to the eye-bolt 22 secured to the left standard 20, as shown in FIGS. 6 and 7. This may require adjusting the length of the guy ropes 30. Proper tension is maintained on the top net rope 12 by the sliding locking mechanism 40 abutting the eye-bolt 22, and by the guy rope 30 extending to the ground. The end of the loop 14 is no longer subject to tension after the guy rope 30 has been disconnected and therefore hangs loosely from the sliding locking mechanism as shown in FIG. 7. The net assembly is now fully assembled and can be used for volleyball games.

The assembly is disassembled simply by disconnecting the hooks 35 and 75 attached to the guy ropes 30 and 70 from the eye-bolts 22 and 72. The net 10 is then rolled up around the standards for storage without changing the position of the sliding locking mechanism 40 on the top net rope 12. Alteratively, the standards 20 and 60 can be removed from the net sleeves 11 and 51 for storage without changing the position of the sliding locking mechanism 40.

The net assembly is reassembled by reinserting the upper ends of the standards 20 and 60 through the net sleeves 11 and 51 and then erecting the standards in their upright positions. The lower ends of the guy ropes are staked to the ground. The hooks 35 and 75 attached to the guy ropes 30 and 70 are then fastened to their respective eye-bolts 22 and 72 secured to the standards 20 and 60 to complete the reassembly process.

It may become necessary to occasionally adjust the tension on the top net rope 12 to compensate for changes in the length of the vinyl tapes 13 and 15 extending along the top and bottom edges of the net 10 due to fatigue or stretching. This is accomplished by manually pulling on the free end of the loop 14 at the left standard 20 with one hand to exert additional tensile force on the top net rope 12. This will cause the sliding locking mechanism 40 to move out of contact with the eye-bolt 22 at the left end of the net. Simultaneously, the other hand releases the sliding locking mechanism 40, moves it upward along the top net rope 12 until it comes into contact again with the eye-bolt 22, and then locks the sliding locking mechanism 40 in place abutting the eye-bolt 22. Conversely, the tension on the top net rope 12 can be reduced by releasing the sliding locking mechanism 40, sliding it a small distance distal from the eye-bolt 22, and locking the sliding locking mechanism in place.

The above disclosure sets forth a number of embodiments of the present invention. Other arrangements or embodiments, not precisely set forth, could be practiced under the teachings of the present invention and as set forth in the following claims.

I claim:

1. A tensioning and support system for a sports net assembly comprising:

two standards spaced a predetermined distance apart;

a net suspended between said standards, said net having an upper edge and two opposing lateral edges adjacent to said standards;

a net rope extending from said net toward at least one of said standards;

at least one guy rope supporting each of said standards;

means for temporarily fastening said guy rope to said net rope to maintain tension placed on said net rope;

means for adjustably fixing the position of said standard relative to said net rope; and means for securing said guy rope to said standard after said position of said standard has been fixed relative to said net rope.

2. The tensioning and support system of claim 1 wherein said means for adjustably fixing the position of said standard comprises a locking mechanism that slides along said net rope.

3. The tensioning and support system of claim 1 wherein said net rope comprises a loop extending from said lateral edge of said net with said standard passing through said loop, and wherein said means for adjustably fixing the position of said standard comprises a locking mechanism that slides along said loop.

4. The tensioning and support system of claim 1 further comprising an eye-bolt secured to said standard, and wherein said net rope comprises a loop extending from said lateral edge of said net with said standard passing through said loop and said loop passing through said eye-bolt, and wherein said means for adjustably fixing the position of said standard comprises a locking mechanism that slides along said loop after it has passed through said eye-bolt.

5. The tensioning and support system of claim 1 wherein said means for temporarily fastening said guy rope to said net rope comprises a hook attached to said guy rope.

6. The tensioning and support system of claim 5 wherein said means for securing said guy rope to said standard comprises an eye-bolt secured to said standard for receiving said hook attached to said guy rope.

7. The tensioning and support system of claim 1 further comprising a sleeve extending along said lateral edge of said net to receive said standard.

8. A tensioning and support system for a sports net assembly comprising:

a net having an upper edge and two opposing lateral edges adjacent to said standards;

two standards spaced a predetermined distance apart for supporting said net;

two sleeves extending along at least a portion of said opposing lateral edges of said net to receive said standards;

at least one guy rope supporting each of said standards;

a net rope loop extending laterally from a lateral edge of said net with one of said standards passing through said net rope loop;

means for temporarily fastening one of said guy ropes to said net rope loop to maintain tension placed on said net;

means for adjustably fixing the position of said standard relative to said net rope loop; and means for securing said guy rope to said standard after said position of said standard has been fixed relative to said net rope loop.

9. The tensioning and support system of claim 8 wherein said means for adjustably fixing the position of said standard comprises a locking mechanism that slides along said net rope loop.

10. The tensioning and support system of claim 8 further comprising an eye-bolt secured to said standard through which said net rope loop passes.

11. The tensioning and support system of claim 8 wherein said means for temporarily fastening said guy rope to said net rope loop comprises a hook attached to said guy rope.

12. The tensioning and support system of claim 11 wherein said means for securing said guy rope to said standard comprises an eye-bolt secured to said standard for receiving said hook attached to said guy rope.

13. A tensioning and support system comprising:

two standards spaced a predetermined distance apart, at least one of said standards having an eye-bolt secured thereto;

a net suspended between said standards, said net having an upper edge and two opposing lateral edges adjacent to said standards;

two sleeves extending along said lateral edges of said net to receive said standards;

at least one net rope loop extending from said net through said eye-bolt of said standard;

at least one guy rope for supporting each of said standards;

a sliding locking mechanism that can be moved along said net rope loop to adjustably fix the position of said standard relative to said net rope loop; and a hook attached to said guy rope for temporarily fastening said guy rope to said net rope loop to maintain tension placed on said net, and then fastening said guy rope to said eye-bolt after said sliding locking mechanism has been fixed in position on said net rope loop.

* * * * *